United States Patent [19]

Eash, II

[11] 4,076,265

[45] Feb. 28, 1978

[54] SKATEBOARD WITH LONGITUDINALLY ADJUSTABLE WHEELS

[76] Inventor: John William Eash, II, 232 Melrose St., Oxnard, Calif. 93030

[21] Appl. No.: 699,371

[22] Filed: Jun. 24, 1976

[51] Int. Cl.[2] ..... B62B 11/00; A63C 1/26

[52] U.S. Cl. ..... 280/87.04 A; 280/11.27

[58] Field of Search ..... 280/87.04 A, 87.04 R, 280/87.02, 80 B, 11.26, 11.27, 11.28, 607, 7.13

[56] References Cited

U.S. PATENT DOCUMENTS

| | | | |
|---|---|---|---|
| 2,190,316 | 2/1940 | Harris | 280/11.26 |
| 2,533,277 | 12/1950 | Miller | 280/11.27 |
| 3,235,282 | 2/1966 | Bostick | 280/11.27 |
| 3,565,454 | 2/1971 | Stevenson | 280/87.04 A |
| 3,802,714 | 4/1974 | Frefgard | 280/607 |
| 3,993,318 | 11/1976 | Rothmayer | 280/11.26 |

*Primary Examiner*—David M. Mitchell

*Attorney, Agent, or Firm*—Ralph B. Pastoriza

[57] ABSTRACT

The longitudinal distance between the front and rear wheels on a skateboard is adjustable to any desired spacing by mounting the wheel trucks on special slide plates. A track in the form of a T groove running longitudinally along the underside of the skateboard receives slide bars which in turn are fastened to the plates through the entrance or stem portion of the T groove, thereby enabling a friction locking of the slide plates to the T groove after desired adjustments have been made.

5 Claims, 4 Drawing Figures

SKATEBOARD WITH LONGITUDINALLY ADJUSTABLE WHEELS

This invention relates generally to skateboards and more particularly to an improved skateboard with longitudinally adjustable wheels.

BACKGROUND OF THE INVENTION

Conventional skateboards include a foot board having a pair of front and rear wheels rotatably mounted on appropriate trucks secured to the underside of the board. The wheel supporting truck structure for both the front and rear wheels is such that when a greater weight is placed on one longitudinal side of the skateboard than the other, the wheels will swivel to turn the skateboard in the direction of the greater weight. Normally, the wheel trucks are permanently secured to the underside of the skateboard and thus their longitudinal spacing is fixed.

It has been found that for certain types of skateboard operation, such as high speed downhill racing, greater stability is achieved if the front and rear wheels are further apart than the distance normally provided. On the other hand when executing various fancy maneuvers in small areas, it is desired to have the front and rear wheels longitudinally spaced closer together, this decreased spacing permitting a tighter turning radius. While different sized skateboards can be purchased wherein the longitudinal spacing between the front and rear wheels is different, and an appropriate skateboard selected for a desired operation, it would be desirable to provide a single skateboard in which the longitudinal distance between the front and rear wheels could be easily adjusted.

Attempts have been made in the past to provide just such a skateboard. One means for accomplishing such adjustment would be to provide a plurality of screw holes on the underside of the board, various ones of which can be selected to secure the trucks to the board. While this solution is satisfactory to a certain extent, the adjustment is limited to discrete steps determined by the spacing between the screw holes. Moreover, it is a somewhat time consuming operation to unthread and thread the screws for each of the trucks, there generally being provided at least four screws for each truck at the corners.

Other proposed solutions have been to provide a track structure beneath the skateboard along which the trucks can ride, there being provided detent means and appropriate indexing slots or openings for receiving the detent means to secure the wheel trucks at desired positions. This latter type structure solves the problem of time involved in removing and resetting screws. On the other hand, detent type locking or even providing registering holes through which pins can pass will not always assure a rigid securement of the wheel truck to the skateboard in its set position. Moreover, there is still involved the problem of limited adjustments in that registering holes or a detent and slot must be aligned. Thus, adjustments can only be made in discrete steps.

BRIEF DESCRIPTION OF THE PRESENT INVENTION

With the foregoing considerations in mind, the present invention contemplates a vastly improved skateboard having longitudinally adjustable wheels which avoids the disadvantages set forth above and characterizing presently available adjustable skateboards.

More particularly, in accord with the present invention, a skateboard is provided with a continuous guide track running along its underside. Front and rear plates are provided secured to the front and rear wheel trucks respectively for the skateboard. Front and rear guiding and locking means coupled to the plates are received in the guide track such that each of the wheel trucks can be individually positioned and secured at any point along the guide track by its associated guiding and locking means.

In the preferred embodiment, the guide track is in the form of an undercut longitudinal groove, each of the guiding and locking means including a member slidable in the groove and fastening means for drawing the member towards the associated coupled plate to lock the member against the undercut portions of the groove.

By the foregoing arrangement, there are virtually an "infinite" number of longitudinal positions for the wheel trucks in any one of which a rigid and secure locking is assured.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
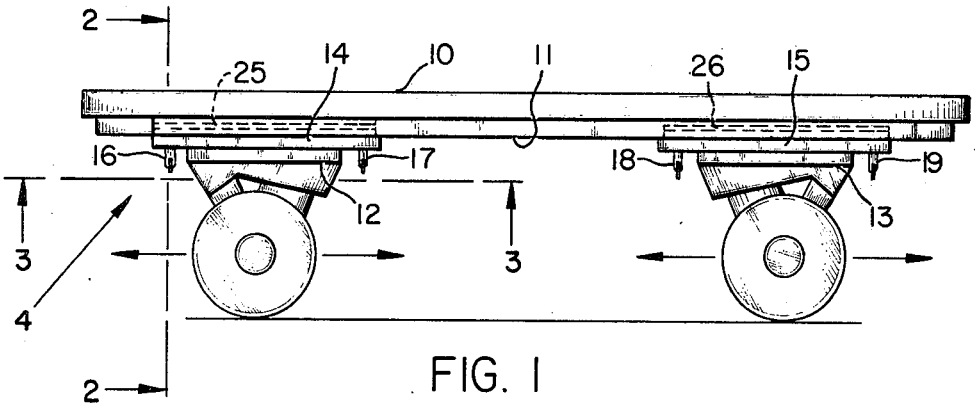
FIG. 1 is a side elevational view of a skateboard having longitudinally adjustable wheels in accord with the present invention.

Referring first to FIG. 1 the skateboard includes a foot board 10 having on its under surface an elongated continuous track 11. Shown beneath the front and rear portions of the board 10 are wheel trucks 12 and 13 respectively secured to special slide plates 14 and 15. As will become clearer as the description proceeds, the slide plates 14 and 15 may be longitudinally adjusted along the track 11 in any desired position and secured in such position by appropriate front and rear guiding and locking means parts of which are seen in FIG. 1 in the form of wing bolts 16, 17, 18 and 19.

Figure 2:
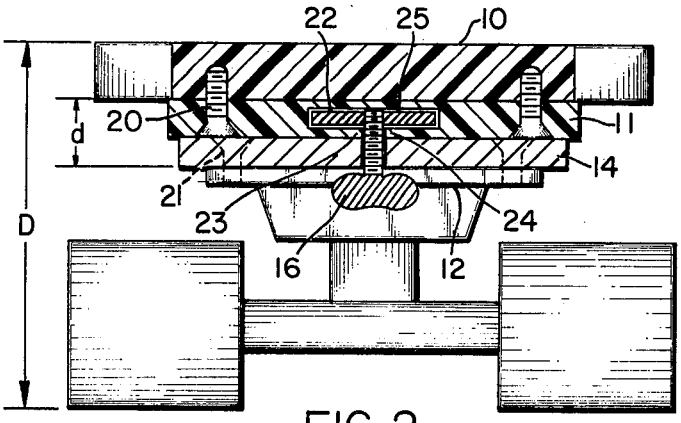
FIG. 2 is a front cross section taken in the direction of the arrows 2—2 of FIG. 1.

Referring now to FIG. 2, the track 11 described in FIG. 1 takes the form of an elongated plastic strip which is securely fastened to the underside of the foot board 10 as by a series of screws adjacent to its longitudinal edges. One such screw is shown at 20 in FIG. 2.

Similarly, the slide plate 14 as described in FIG. 1 has secured to it the truck 12 as by flat head screws at the four corners of the truck, one of which is shown at 21. By using countersunk flat head screws, the top surface of the slide plate can be disposed in flush surface engagement with the strip 11.

The slide plate 15 described in FIG. 1 is similarly secured to its truck 13 for the rear wheels.

The front and rear guiding and locking means cooperating with the strip 11 are identical for both the front and rear slide plates 12 and 13 and thus a detailed description of the front guiding and locking arrangement will suffice for both.

Thus, still referring to FIG. 2, the guide track in the strip 11 takes the form of a continuous central channel 22 having inwardly opposed flanges 23 and 24 to define a T groove running longitudinally along the center line of the board and strip. Within the channel 22 defining the cross portion of the T groove is positioned a slide bar 25 of rectangular cross section. The corresponding slide bar for the rear locking and guiding means is indicated in dashed lines at 26 in FIG. 1.

As will become clearer as the description proceeds, the slide plates such as the slide plate 14 includes longitudinally spaced openings and each of the slide bars includes longitudinally spaced threaded bores exposed between the opposed flanges 23 and 24 defining the stem portion of the T groove. Threaded bolts in the form of the wing bolts such as illustrated at 16 have heads of larger diameter than the openings in the slide plates and shank portions receivable through the openings and into the stem portion of the T groove to be threadedly received in the longitudinally spaced threaded bores of the slide bar.

Figure 3:
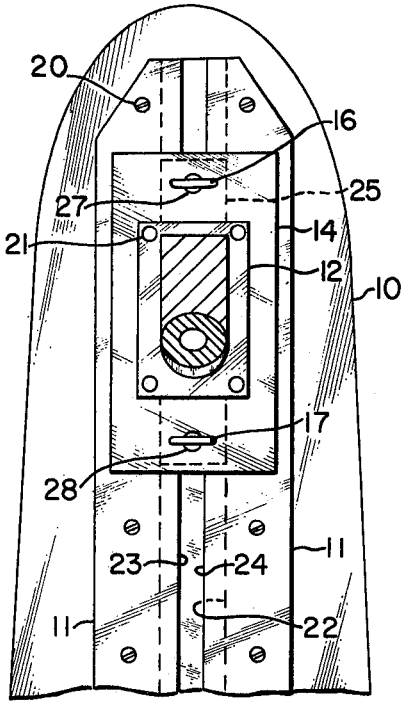
FIG. 3 is a fragmentary bottom cross section taken in the direction of the arrows 3—3 of FIG. 1; and, FIG. 4 is a fragmentary perspective exploded view of basic components making up the guiding and locking means in accord with the present invention.

In FIG. 3, the two openings in the slide plate 14 are indicated at 27 and 28 receiving the corresponding wing bolts 16 and 17. The opening out of the T groove from the front of the strip 11 is clearly evident in FIG. 3. Further, the channel 22 and opposed flanges 23 and 24 making up the continuous T groove are shown in FIG. 3.

Figure 4:
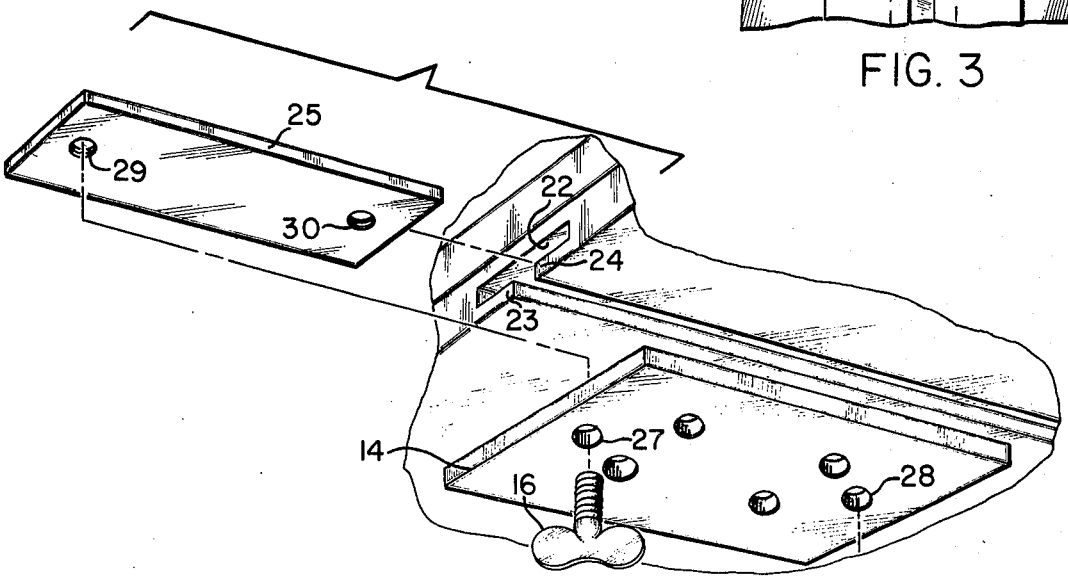

In the exploded fragmentary perspective view of FIG. 4, there is illustrated the slide bar 25 removed from the channel 22 of the T groove wherein the longitudinally spaced threaded bores are shown at 29 and 30, this spacing corresponding to the longitudinal spacing between the openings 27 and 28 in the slide plate 14. With the slide bar 25 received in the channel 22 and the wing bolts 16 and 17 described in FIG. 1 threaded into the bores 29 and 30 of the slide bar, it will be clear that upon tightening of the wing bolts, the slide bar will be drawn against the underside of the inwardly opposed flanges 23 and 24 and thereby sandwich and grip these flanges between the slide bar and the top surface of the slide plate. The longitudinal length of each slide bar corresponds to the longitudinal length of its associated slide plate so that a gripping force is applied along the entire length of the slide plate by the slide bar.

As mentioned, the rear slide plate 15 and cooperating slide bar 26 illustrated in FIG. 1 are provided with similar openings and threaded bores for securing the rear truck in a desired set position by tightening of the wing bolts 18 and 19.

Since each slide bar is co-extensive in a longitudinal direction with its cooperating slide plate, and further because of its rectangular cross section and proper dimensioning to fit closely within the channel portion 22 of the T groove, it will be clear that when the wing bolts such as 16 and 17 described for the front slide plate are loosened slightly, the entire slide plate along with the wing bolts and slide bar can readily be longitudinally moved to any desired position on the track 11. In this respect, the slide bar 22 serves as a guide for this movement.

When the wing bolts are tightened after moving the slide plate 14 and cooperating slide bar 25 to a desired position the slide bar serves the additional function of a secure locking means by its pressure along its entire length against the underside of the opposed flanges 23 and 24 of the T groove.

It will be clear from the foregoing structure that any desired position may be selected, there being required no detents or registering openings in the locking operation. Moreover, the locking is extremely secure in that there is large contact area in the sandwiching of the inwardly opposed flanges 23 and 24 between each slide bar and its cooperating slide plate.

Additional advantages accrue from the foregoing described arrangement. For example, it is very easy to loosen the wing bolts and simply slide each slide plate out from opposite ends of the T groove, thereby enabling rapid and easy removal of the entire front and rear wheel trucks. Other wheel trucks provided with appropriate slide plates can then readily be substituted. Alternatively, the wing bolts can simply be unthreaded completely from their cooperating slide bars and the slide plates with connected trucks lifted from the bottom of the strip 11 and others substituted.

Another advantage will be understood by reference to FIG. 2 wherein it will be noted that the elevation of the foot board 10 above the wheel trucks designated D is increased over such elevation in the absence of the track or strip 11 and slide plate 14 by an amount corresponding to the combined thicknesses of the track and slide plate. This combined thickness is indicated by the letter *d*. By controlling the combined thickness *d* of the track 11 and plate 14, the overall elevational distance D of the foot board 10 above the wheel truck can be controlled.

With respect to the foregoing, it is not uncommon practice for users of conventional type skateboards to provide shims between the wheel trucks and the underside of the skateboard itself in order to increase the elevational distance between the skateboard and the wheel trucks. The reason for increasing this distance is to provide greater room to accommodate side tilting movement of the skateboard when making sharp turns. With many presently available skateboards, the edge of the skateboard itself when steeply tilted in making a sharp turn can actually contact the wheels. Such inadvertent contact is avoided by increasing the referred to distance.

The addition of the strip 11 and slide plate 14 in order to provide longitudinally adjustable wheels in accord with the present invention thus simultaneously solves the foregoing problem, the combined thicknesses of the strip 11 and slide plate 14 as indicated at *d* in FIG. 4 increasing this elevation and thus avoiding the neccessity of providing shims.

Notwithstanding the foregoing, it should be understood that rather than provide the adjustability feature for the wheel trucks as an attachment to a conventional skateboard, it is possible to initially manufacture the board with the T shaped groove formed directly in the board itself thereby eliminating the need for the strip 11. In this event, the slide plates such as 14 illustrated in FIG. 2 could be made of sufficient thickness to provide the desired spacing between the board and wheel trucks.

Most of the more recently manufactured skateboards are of plastic material to provide flexibility. Thus, in the preferred embodiment of this invention, the track will be in the form of a plastic strip for securement to the underside of the board as indicated by the cross section in FIG. 2 so that this plastic strip can flex with the board. On the other hand, the slide plates which are of substantially shorter longitudinal extent would preferably be formed of metal such as aluminum for purposes of strength. The slide bars such as the bar 25 illustrated in FIG. 2 would also be metal, preferably stainless steel. The provision of plastic material for the strip 11 is extremely desirable not only from the flexibility standpoint but from the fact that the inwardly opposed flange portions 23 and 24 are sandwiched between and gripped by the metal slide bar 22 and the top surface of the metal slide plate 14. The plastic can give slightly and thus a very large force can be applied with high friction between the plastic and metal. If a hard substance such as metal were used for the strip 11 and thus for the flange portions 23 and 24, there would not be any "give" in threading the wing bolts and under vibrations and the like, the fastening could work loose.

While wing bolts have been shown in the preferred embodiment for easy manual operation, it should be understood that any appropriate fastening bolt having a head portion larger than the openings in the slide plates could be used to effect the fastening, the head having a screw slot or an Allen-head receiving socket. Further, appropriate washers could be used beneath the head to facilitate tightening and loosening of the fastening.

From all of the foregoing, it will thus be evident that the present invention has provided a very simple and elegant structure for enabling longitudinal adjustment of the spacing between the front and rear wheels of a skateboard as well as between the front and rear wheels and end portions of the skateboard which adjustments can be independently carried out for each of the wheel trucks. The skateboard can thus be appropriately adjusted for optimum performance in accord with the type of skateboarding operation to be carried out.

What is claimed is:

1. A skateboard with longitudinally adjustable wheels including, in combination:

a. a footboard having elongated track means running along its underside;

b. front and rear wheel trucks;

c. front and rear guiding and locking means for said front and rear wheel trucks, respectively, for securing said front and rear wheel trucks to adjacent portions of said track means in selected longitudinal positions, each of said guiding and locking means including:

1. slide plate means on said associated truck means having a top surface engaging the under surface of the adjacent portion of said track means, said adjacent portion of said track means being in the form of a central channel having inwardly opposed flanges to define a T groove running longitudinally along the underside of said footboard, said slide plate means including longitudinally spaced openings;

2. slide bar means of rectangular cross section received in said channel defining the cross portion of said T groove and including longitudinally spaced threaded bores exposed between the opposing flanges defining the stem portion of said T groove; and, 3. threaded bolt means having heads of larger diameter than said openings and shank portions individually receivable through said longitudinally spaced openings in said slide plate means and in said stem portion of said T groove to be threaded in said longitudinally spaced threaded bores, whereby said trucks may be longitudinally positioned along said track means at a desired spacing from each other and the front and rear ends of said footboard, said slide bar means serving as guides for such longitudinal positioning, and whereby said trucks may be secured in their set positions by tightening of said threaded bolt means to draw said slide bar means against the underside of said inwardly opposed flanges and thereby sandwich and grip said flanges between said slide bar means and the top surfaces of said slide plate means.

2. A skateboard with longitudinally adjustable wheels including, in combination:

a. a foot board having on its under surface an elongated track in the form of a central channel having inwardly opposed flanges to define a T groove running longitudinally along the center line of said board;

b. front and rear wheel trucks;

c. front and rear slide plates having their bottom surfaces secured to said wheel trucks respectively and their top surfaces engaging the under surface of said track, each of said slide plates including longitudinally spaced openings;

d. front and rear slide bars of rectangular cross section received in said channel defining the cross portion of said T groove and positioned adjacent to opposite end portions of said track respectively, each of said slide bars having a pair of longitudinally spaced threaded bores exposed between the opposing flanges defining the stem portion of said T groove; and e. threaded bolt means having heads of larger diameter than said openings and shank portions individually receivable through said longitudinally spaced openings in said slide plates and in said stem portion of said T groove to be threaded in said longitudinally spaced threaded bores, whereby said trucks may be longitudinally positioned along said track at a desired spacing from each other and the front and rear ends of said board, said slide bars serving as guides for such longitudinal positioning, and whereby said trucks may be secured in their set positions by tightening said threaded bolt means to draw said slide bars against the underside of said inwardly opposed flanges and thereby sandwich and grip said flanges between said slide bars and the top surfaces of said slide plates, the longitudinal length of said slide bars corresponding to the longitudinal length of said slide plates, respectively, so that a gripping force is applied along the entire length of said slide plates by the slide bars, said slide bars thereby serving the additional function of a securing means for said trucks.

3. A skateboard according to claim 2, in which said T groove opens out the front and rear ends of said track so that each of said trucks and associated slide plate, bar and bolt means can be readily slid out of said T groove and completely separated from said foot board by loosening said bolt means.

4. A skateboard according to claim 2, in which said foot board is made of flexible plastic material, said track constituting an elongated flexible plastic strip within which said T groove is formed, said strip being secured to the underside of said foot board for flexing therewith, whereby the elevation of said foot board above the wheel trucks is increased over such elevation in the absence of said track and slide plates by an amount corresponding to the combined thickness of the track and slide plates, controlling of said combined thickness thereby enabling a desired elevation of said foot board to be realized.

5. A skateboard according to claim 2, in which the heads of said bolt means comprise wings to define wing bolts whereby tightening and loosening of said bolt means can be accomplished manually, the necessity of a special tool for making adjustments in the longitudinal positions of said wheel trucks thus being avoided.

* * * * *